United States Patent [19]

McCoy

[11] Patent Number: 5,019,207

[45] Date of Patent: May 28, 1991

[54] PRODUCT LABEL HANDLING MACHINE

[75] Inventor: Gary W. McCoy, Evans City, Pa.

[73] Assignee: Carl Strutz and Company, Inc., Mars, Pa.

[21] Appl. No.: 342,324

[22] Filed: Apr. 29, 1989

[51] Int. Cl.[5] ..... B65C 9/02; B65C 9/08

[52] U.S. Cl. ..... 156/571; 414/225; 414/732; 414/736; 414/737; 414/738; 414/798.9

[58] Field of Search ..... 271/95, 96; 414/732, 414/736, 737, 738, 798.9, 904, 788.7, 225; 156/571

[56] References Cited

U.S. PATENT DOCUMENTS

| | | | |
|---|---|---|---|
| 2,915,308 | 12/1959 | Matzen | 271/95 X |
| 3,302,946 | 2/1967 | Anderson | 271/95 |
| 3,528,871 | 9/1970 | Münch | 156/571 |
| 3,682,470 | 8/1972 | Takagi et al. | 271/95 |
| 3,954,542 | 5/1976 | Solomon et al. | 414/736 X |
| 3,981,667 | 9/1976 | Bilodeau | 414/730 X |
| 4,242,168 | 12/1980 | Carter | 156/571 X |
| 4,469,548 | 9/1984 | Jörss | 156/571 X |
| 4,516,765 | 5/1985 | Stocco et al. | 271/95 |
| 4,614,018 | 9/1986 | Krall | 414/225 X |
| 4,643,633 | 2/1987 | Lashyro | 414/732 |
| 4,699,374 | 10/1987 | Hain | 271/95 X |
| 4,867,833 | 9/1989 | McCoy | 156/361 |

*Primary Examiner*—Robert J. Spar
*Assistant Examiner*—Janice Krizek
*Attorney, Agent, or Firm*—Clifford A. Poff

[57] ABSTRACT

A device is disclosed for handling and transporting workpieces such as sheet-like labels between a plurality of stations. The stations include at least are workpiece pick-up station in the form of a magazine, at least one workpiece treatment station at which a tag or sticker may be applied to the workpiece, and at least one workpiece deposit station. A workpiece is removed from the magazine by at least one suction device which holds the workpiece as it is transported to, and as it is treated by, the treatment station. The suction device then transports the treated workpiece to the deposit station at which point the suction device releases the treated workpiece. The plurality of stations are disposed equaliangularly about the handling and transporting device; and the suction device is rotated to each successive station such that its outer surface is normal to the presentation surface of each station when the suction device arrives at each station.

37 Claims, 8 Drawing Sheets

PRODUCT LABEL HANDLING MACHINE

BACKGROUND OF THE INVENTION

1. Field of the Invention

This invention relates to the art of material and article handling devices, in general, and product label handling devices, in particular.

2. Description of the Prior Art

An apparatus for dispensing product labels is disclosed in my co-pending U.S. patent application Ser. No. 095,687, filed Sept. 14, 1987, entitled BUTT CUT LABEL DISPENSING MACHINE which issued as U.S. Pat. No. 4,867,833, the disclosure of which is incorporated herein by reference.

It is common practice to display the price of a consumer product directly on the label of the product. Such price display may be obtained by a number of conventional methods. For example, the price of the product may be printed on the label at the time when the product label itself is printed.

Such a method has the inherent disadvantages of potentially printing an incorrect price on the label or printing a price on the label which, by the time the product reaches the retail customer, may not be the price at which the retailer desires to sell the product.

If the printing of the price directly on the product results in either of the undesired situations mentioned above, then steps must be taken to correct the problem. These steps may entail the costly printing of new labels with the correct price thereon for replacement of the incorrectly priced labels or, the incorrect price on the labels may be covered over manually by tags or stickers having the correct price thereon.

Another example of a method for providing the cost of a product on a product label involves printing the product label without a price thereon and subsequently, usually manually, the retailer provides the label with a tag or sticker bearing the desired product price.

Each of the above-mentioned methods for providing the price of a product directly on the product label suffer from the serious disadvantages of cost and time inefficiency.

It is therefore an object of the invention to provide a device for rapidly producing product labels with the appropriate price thereon.

It is a further object to provide a device for covering the price displayed on incorrectly-priced labels with tags or stickers bearing the correct product price.

It is a further object to provide a device for furnishing unpriced product labels with tags or stickers bearing the appropriate price thereon.

Still other objects and advantages will become apparent when one considers the attached drawings and the description of the invention presented herein below.

SUMMARY OF THE INVENTION

To overcome the problems related to the incorrect pricing of product labels, there is provided an apparatus for handling and transporting workpieces, such as sheet-like product labels, between a plurality of stations. The apparatus includes a housing, a motor contained within the housing and a shaft rotatably driven by the motor. The apparatus further includes means for handling the sheet-like workpieces or labels and means for connecting the shaft to the handling means for transporting the handling means between the plurality of stations. The plurality of stations include: 1.) At least one workpiece pick-up station, such as a magazine for holding a plurality of the workpieces; 2.) at least one workpiece treatment station at which an operation, such as the application of a tag or sticker, is performed on the workpiece, and 3.) at least one workpiece deposit station where the treated workpiece is deposited. The apparatus may be operated continuously at rapid speed to provide a large number of product labels with correct product prices in a short period of time. Other than during routine maintenance, the only downtime encountered by the apparatus is the time in which the label magazine and/or the price sticker applicator require refilling.

DESCRIPTION OF THE PREFERRED EMBODIMENTS

Figures 1, 1A:
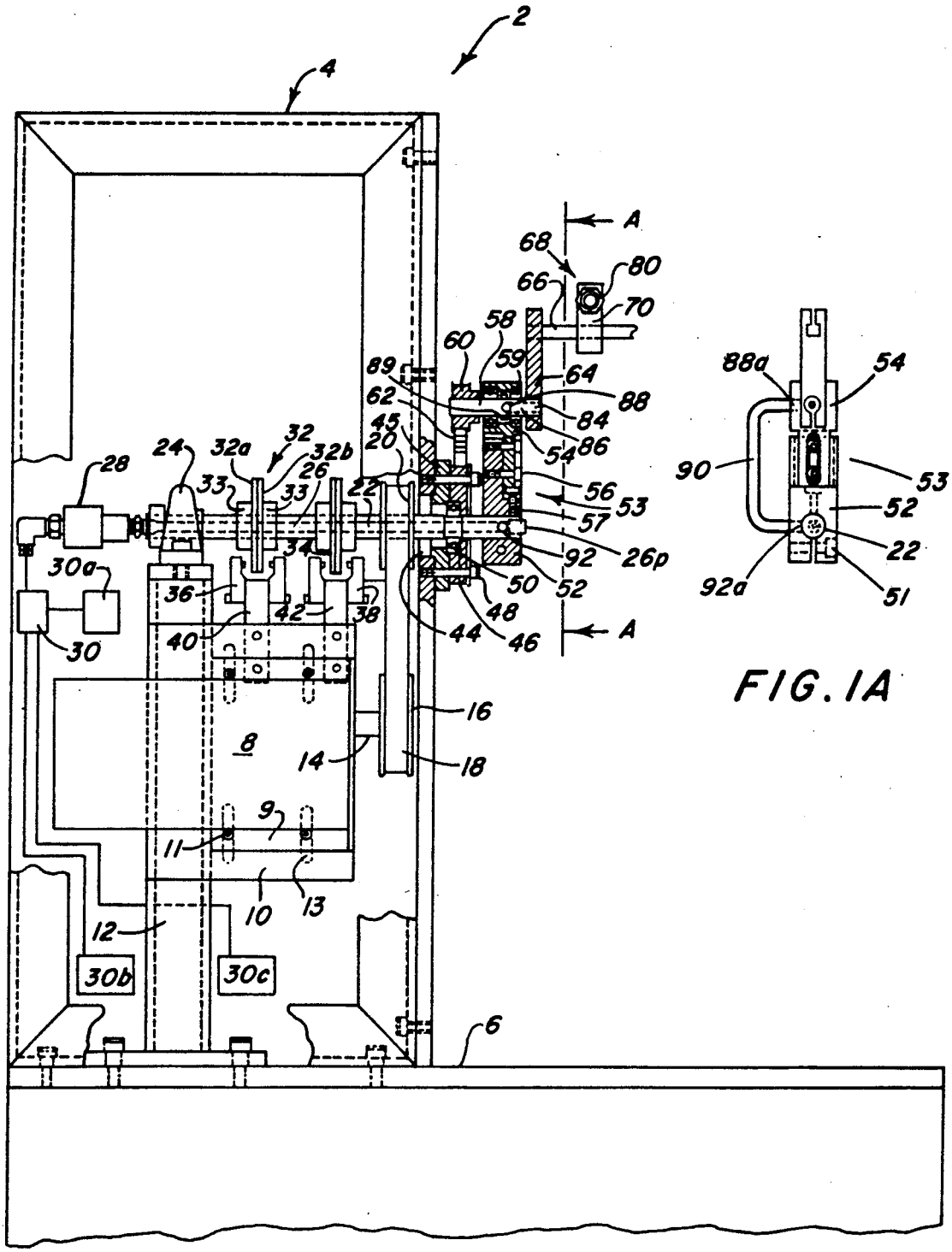
FIG. 1 is an elevational side view, partially in section, of a first embodiment of the label handling machine of the present invention.
FIG. 1A is a view of a portion of the label handling machine of the present invention as viewed along line A—A of FIG. 1.
Figure 2:
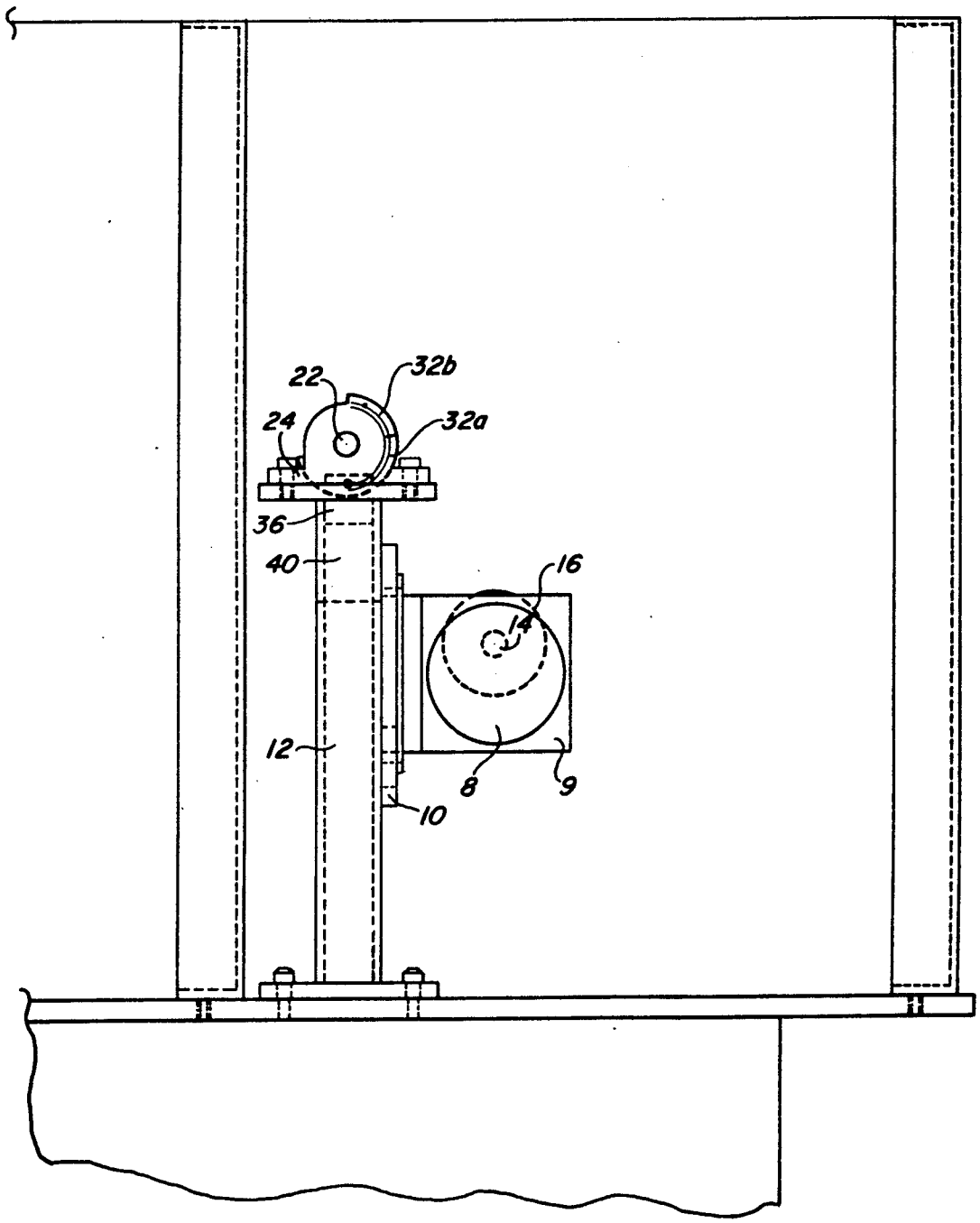
FIG. 2 is a rear view of the device shown in FIG. 1.

FIG. 1 depicts a product label handling machine 2 having a housing 4 which is secured by suitable means to a base 6.

Within the housing 4 is a motor 8. Motor 8 is fixedly secured to an L-shaped bracket 9, which, in turn, is adjustably mounted on a motor mount 10 by suitable fasteners 11. Motor mount 10 is fixedly secured to a vertical support column 12 as by welding, for example. Fasteners 11 extend through bores in L-shaped bracket 9 and also through vertical slots 13 in motor mount 10. By this construction, adjustment of the position of the motor 8 is achieved by loosening the fasteners 11, setting the desired position of the motor 8 along slots 13, and then tightening the fasteners 11.

Extending from and rotatably driven by the motor 8 is a shaft 14. Fixed to the shaft 14 is a pulley 16. Pulley 16, through belt 18, drives a pulley 20 which, in turn, is fixed to and drives a shaft 22. Shaft 22 is rotatably supported near a first end thereof by a pillow block 24 which is mounted atop vertical support column 12.

Figures 6, 7:
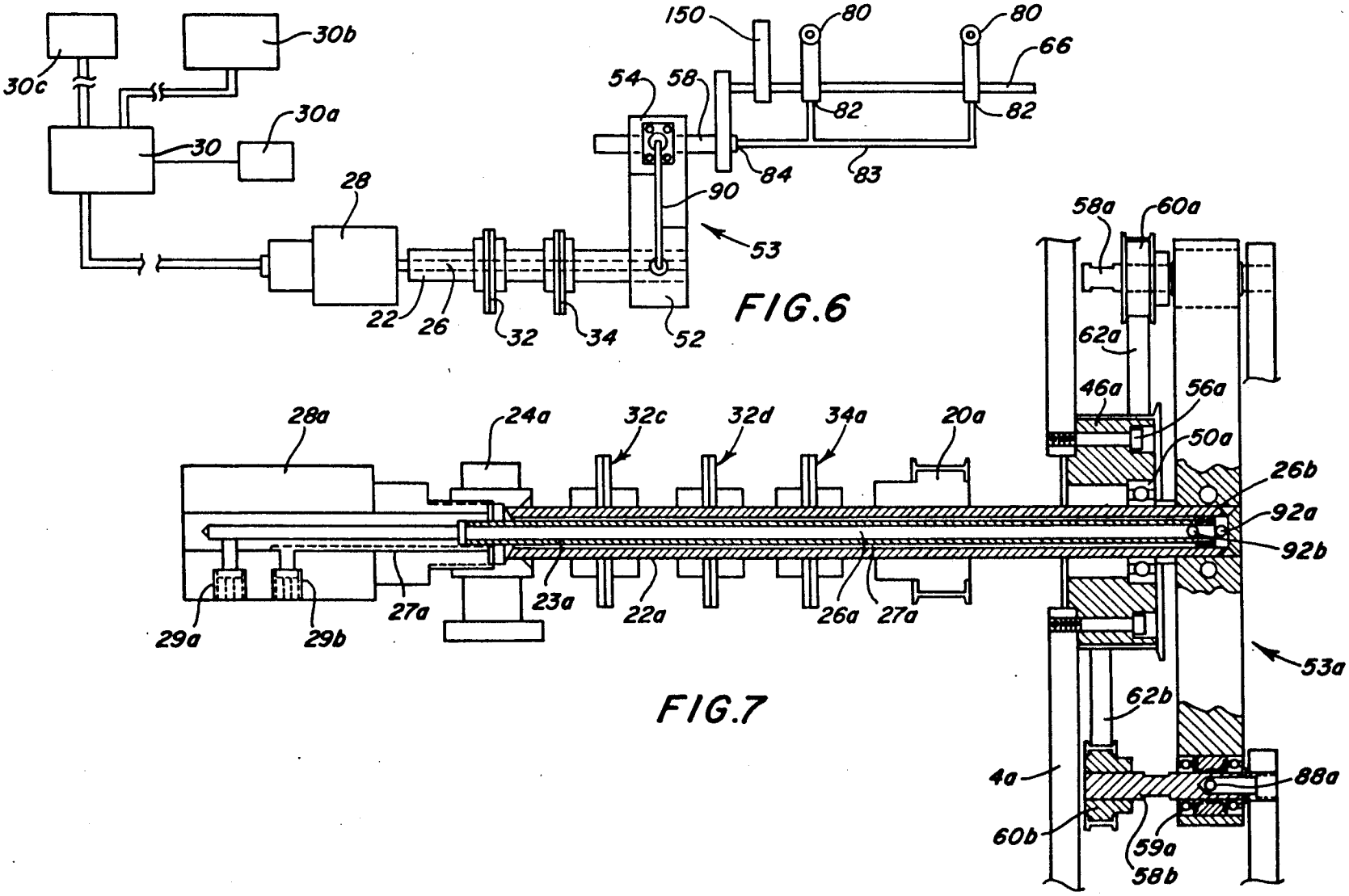
FIG. 6 is a schematic view of the product label handling machine.
FIG. 7 is a side view, partially in section, of a second embodiment of the present invention.

Shaft 22 is provided with a longitudinal bore 26 extending along the entire length of the shaft. At a first end of the shaft 22 nearest the pillow block 24, there is attached a rotatable pressure coupling 28 which provides communication between bore 26 in shaft 22 and either a pressurized air source **30*b* or a vacuum source 30c. The opposite end of the bore 26 in between vacuum source 30c, pressurized air source 30*b*, and rotatable pressure coupling 28 is shown in FIG. 1 and FIG. 6. A control means 30*a* responsive to the angular position of shaft 22 controls the position of a diverter valve 30 such that either a burst of pressurized air provided from pressurized air source 30*b* or suction provided from vacuum source 30c is communicated through pressure coupling 28 to bore 26 in shaft 22**. Actuation and operation of the pressurized air and vacuum systems is described in greater detail hereinbelow.

Flange members 32 and 34 are provided on the outer circumference of shaft 22 intermediate the ends thereof. The specific functions of flange members 32 and 34 are described hereinbelow.

As seen in FIG. 1, a second end of the shaft 22 extends through an aperture 44 in housing 4. Near this second end, the shaft 22 is rotatably supported by suitable bearings 50 housed within a pulley 46. Pulley 46 is fixed to housing 4 by fasteners 48. When fastened to housing 4 by fasteners 48, the pulley 46 is held against rotation and is stationery relative to housing 4. Pulley 46 is spaced from housing 4 by a spacer member or shim 45. Fasteners 48 extend through shim 45 as well as through pulley 46.

An arm means 53 is fixedly attached at a first end thereof to the second end of shaft 22. Arm means 53 is preferably formed as two separate arm portions 52 and 54. Arm portions 52, 54 are secured to one another by suitable fasteners 56. Arm portion 52 is fixedly secured to shaft 22 by clamping bolt 51 (FIG. 1A). Arm portion 54 has bearings 59 therein for rotatably supporting a second shaft 58. Shaft 58 extends parallel to shaft 22. Fixed to the end of shaft 58 nearest the housing 4 is a pulley 60. Pulley 60 is linked to pulley 46 through belt 62. Preferably, pulleys 46 and 60 are toothed pulleys and belt 62 is a toothed belt having teeth which mate with the teeth of pulleys 46 and 60. The mating of the teeth of the belt and pulleys prevents slippage of the belt about the pulleys during operation of the product label handling machine. The tension in belt 62 is adjusted by adjustment bolt 57 which adjusts the position of arm portion 54 relative to arm portion 52. Adjustment of the position of arm portion 54 relative to arm portion 52 accordingly adjusts the position of pulley 60 relative to pulley 46 and thus the tension in belt 62 connecting the pulleys.

A crank arm 64 is fixedly attached at one end thereof to the opposite end of shaft 58.

Other possible arrangements for connecting the driven shaft with the crank arm are shown in FIGS. 3, 3A, 4 and 4A. Elements in FIGS. 3 and 3A which are analogous to those in FIG. 1 are designated with prime symbols. Elements in FIGS. 4 and 4A which are analogous to those in FIG. 1 are designated with double prime symbols.

Figure 3:
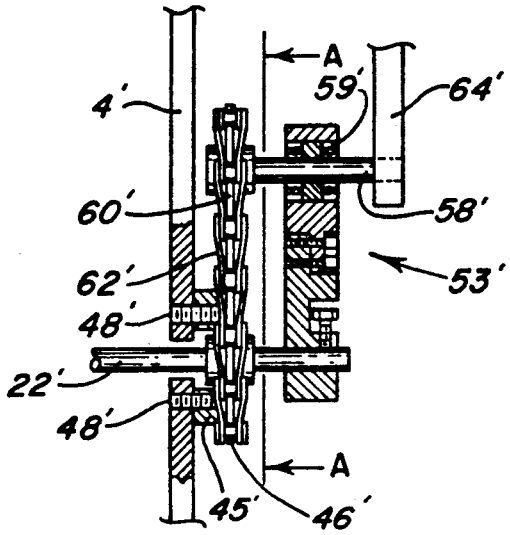
FIG. 3 is an enlarged side view, partially in section and with some elements not shown for purposes of clarity, of an alternative arrangement of the drive system of the present invention.
Figure 3A:
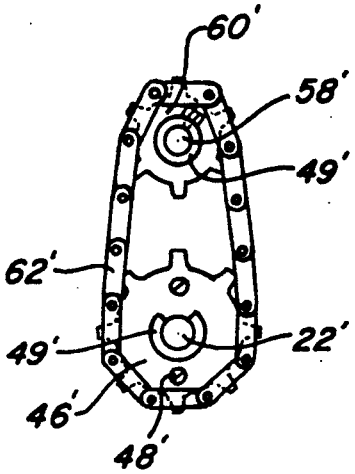
FIG. 3A is a view taken along line A—A of FIG. 3.

In the arrangement depicted in FIGS. 3 and 3A, the structure for connecting the driven shaft to the crank arm is virtually identical to that shown in FIG. 1. The only difference being that instead of the pulleys 46 and 60 as shown 10 in FIG. 1, FIGS. 3 and 3A illustrate the use of sprockets 46' and 60'. And, instead of a belt 62 as shown in FIG. 1, FIGS. 3 and 3A provide a chain 62' for operably linking pulleys 46' and 60'. Otherwise, the essential features of FIGS. 3 and 3A remain the same as those in FIG. 1, i.e., 1) sprocket 46' is fixedly attached to housing 4' just as pulley 46 is fixedly attached to housing 4 in FIG. 1, 2) driven shaft 22' is rotatably supported within sprocket 46' by suitable bearings (not shown), just as driven shaft 22 is rotatably supported within pulley 46 in FIGS. 1, and 3) sprocket 60' is fixedly attached to shaft 58' just as pulley 60 is fixedly attached to shaft 58 in FIG. 1, etc.

Figure 4:
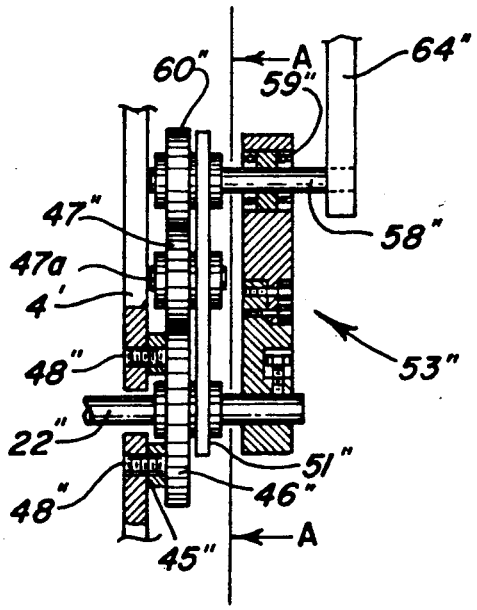
FIG. 4 is an enlarged side view, partially in section and with some elements not shown for purposes of clarity, of an alternative arrangement of the drive system of the present invention.
Figure 4A:
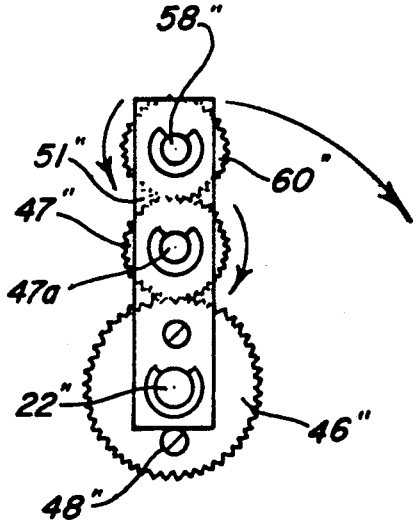
FIG. 4A is a view taken along line A—A of FIG. 4.

The arrangement of FIGS. 4 and 4A denotes a possible gearing arrangement for connecting the driven shaft to the crank arm. Gear 46'' is analogous to pulley 46 in FIG. 1 and is similarly fixedly attached to housing 4''. Gear 60'' is analogous to pulley 60 in FIG. 1. The means linking gear 46'' and gear 60'' in FIGS. 4 and 4A comprise an idler gear 47'' and linking bar 51''. Idler gear 47'' is fixedly attached to a shaft **47*a* which is rotatably supported in linking bar 51''. In fact all of the shafts 22'', 47*a* and 58'', are rotatably supported in linking bar 51''. Linking bar 51'' merely acts to retain gears 46'', 47'' and 60'' in proper meshing engagement with one another. In all other aspects the depictions of FIGS. 4 and 4A are identical to the arrangements depicted in FIGS. 1, 3 and 3A**.

In each of the embodiments of FIGS. 1, 3, 3A, 4 and 4A the motion of the driven shaft and the motion induced on the crank arm are identical. The depiction of FIG. 1 may be used for purposes of illustration. In FIG. 1, motor 8 turns shaft 14 and the pulley 16 fixed thereto. Pulley 16, through belt 18 turns pulley 20 which is fixed to driven shaft 22. Driven shaft 22 is rotatably supported in and extends beyond pulley 46 which is fixed to housing 4. The end of shaft 22 extending beyond pulley 46 turns arm means 53, an end of which is fixed on shaft 22. The opposite end of arm means 53, and shaft 58 rotatably supported therein, then travel an orbital path around stationary pulley 46. Pulley 60, which is fixed to shaft 58, accordingly follows an orbital path around stationary pulley 46. As pulley 60 traverses its orbital path about stationary pulley 46, the inner surface of belt 62 which links the pulley 60 with stationary pulley 46 causes pulley 60, and thus shaft 58, to rotate in a direction which is opposite to that of the direction of rotation of driven shaft 22. Crank arm 64 which is fixed at a first end thereof to the opposite end of shaft 58 likewise is caused to rotate in a direction opposite to the direction of rotation of driven shaft 22.

Identical relative motions between the crank arm and the driven shaft are obtained in the arrangements depicted in FIGS. 3, 3A, 4 and 4A. Still other suitable arrangements for linking the crank arm and the driven shaft are contemplated which will produce the desired motions. However, further examples of such are considered unnecessary to explain and any suitable means for producing such relative motions are considered to be within the spirit and scope of those already disclosed herein.

A support rod 66 is fixedly attached near a second end of crank arm 64. Support rod 66 extends outwardly from crank arm 64 parallel to shafts 22 and 58. Supported on support rod 66 is at least one label handling means in the form of suction device 68.

Figure 9:
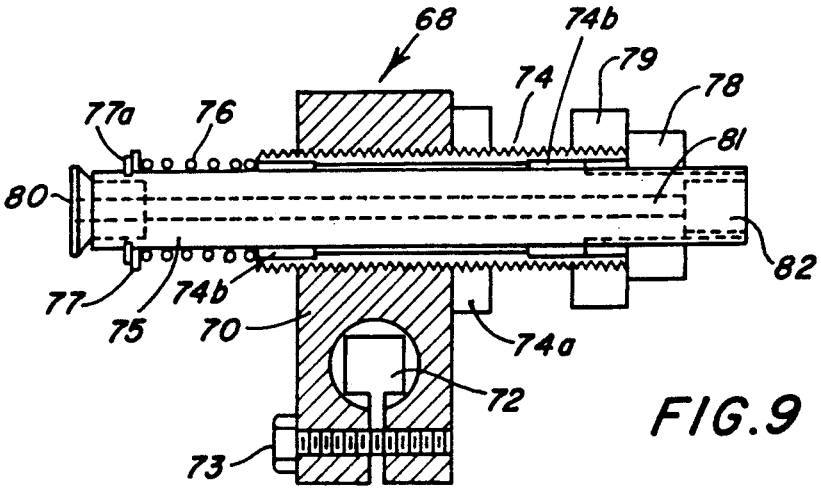
FIG. 9 is an enlarged side view, partially in section, of a suction device used in the present invention.

As most clearly seen in FIG. 9, suction device 68 includes a mounting member 70 having an aperture 72 therein which is slightly larger than, but generally corresponding to, the size and cross-sectional shape of support rod 66. Suction device 68 is adjustably positionable along the length of support rod 66 by loosening clamp screw 73, appropriately positioning suction device 68, and then tightening the clamp screw 73 to lock the suction device in the desired position.

Threadably and adjustably received in mounting member 70, transverse to aperture 72, is hollow cylindrical threaded sleeve member 74. Member 74 is locked in a desired position relative to mounting member 70 by a lock nut **74*a* and supports a cylinder 75 via bushings 74*b* for limited reciprocation therein. The limited reciprocation of cylinder 75 is effected by the force of a biasing spring 76. The spring 76 has a forward portion abutting a washer 77 which is retained by a snap ring 77*a* which, in turn, is secured to a forward portion of cylinder 75. The rearward portion of spring 76 abuts the front of forward bushing 74*b* in sleeve 74. A stop member 78 is mounted near the rear end of cylinder 75. Stop member 78 is limited in its forward motion by contact with a similar stop member 79 secured to sleeve member 74. The purpose of providing adjustment between the sleeve member 74 and the mounting member 70 in suction device 68 is to allow the forwardmost end of the suction device to extend beyond, or inwardly of, the face of a storage receptacle such as a magazine in order to remove labels which may be resting in an inwardly concave relationship relative to the magazine face. Still further, the spring-biased reciprocating cylinder 75 in suction device 68** will also retract when encountering a label protruding in a convex relationship relative to the magazine face in order to remove the protruding label from the magazine.

Attached to the forwardmost end of cylinder 75 is a suction cup 80. An aperture in suction cup 80 communicates with a longitudinal bore 81 in cylinder 75. A port 82 is located at the rear of cylinder 75 and communicates with bore 81.

As seen in FIG. 6, the port 82 at the rear of each suction device is connected to suitable tubing such as flexible hose means 83. The hose means are then, in turn, connected to a port 84 provided in an outer end of shaft 58, as most clearly seen in FIG. 1. Port 84 communicates with a longitudinal bore 86 which extends partially along the length of shaft 58.

Bore 86 communicates with a lateral port 88 in rotatable shaft 58. Lateral port 88 is sealed from leakage by conventional O-rings 89 provided around shaft 58 on both sides of lateral port 88. Lateral port 88 communicates with a side bore **88*a* in arm portion 54 of arm means 53. The side bore 88*a* of arm portion 54 communicates via tubing 90 (FIGS. 1A and 6) with a side bore 92*a* in arm portion 52 of arm means 53. The side bore 92*a* of arm portion 52 communicates with a lateral port 92 in shaft 22. Lateral port 92 communicates with longitudinal bore 26 of driven shaft 22. As stated previously, and as most clearly shown in FIG. 6, the longitudinal bore 26 of shaft 22 is in communication with either a vacuum source 30*c* or a pressurized air source 30*b*. As one can now readily see, there is a direct line of either suction or pressurized air provided between vacuum source 30*c* or pressurized air source 30*b*, and the outer surface of the suction cups 80 of suction device 68, depending, of course, on the angular position of shaft 22** during each revolution thereof.

Figure 5:
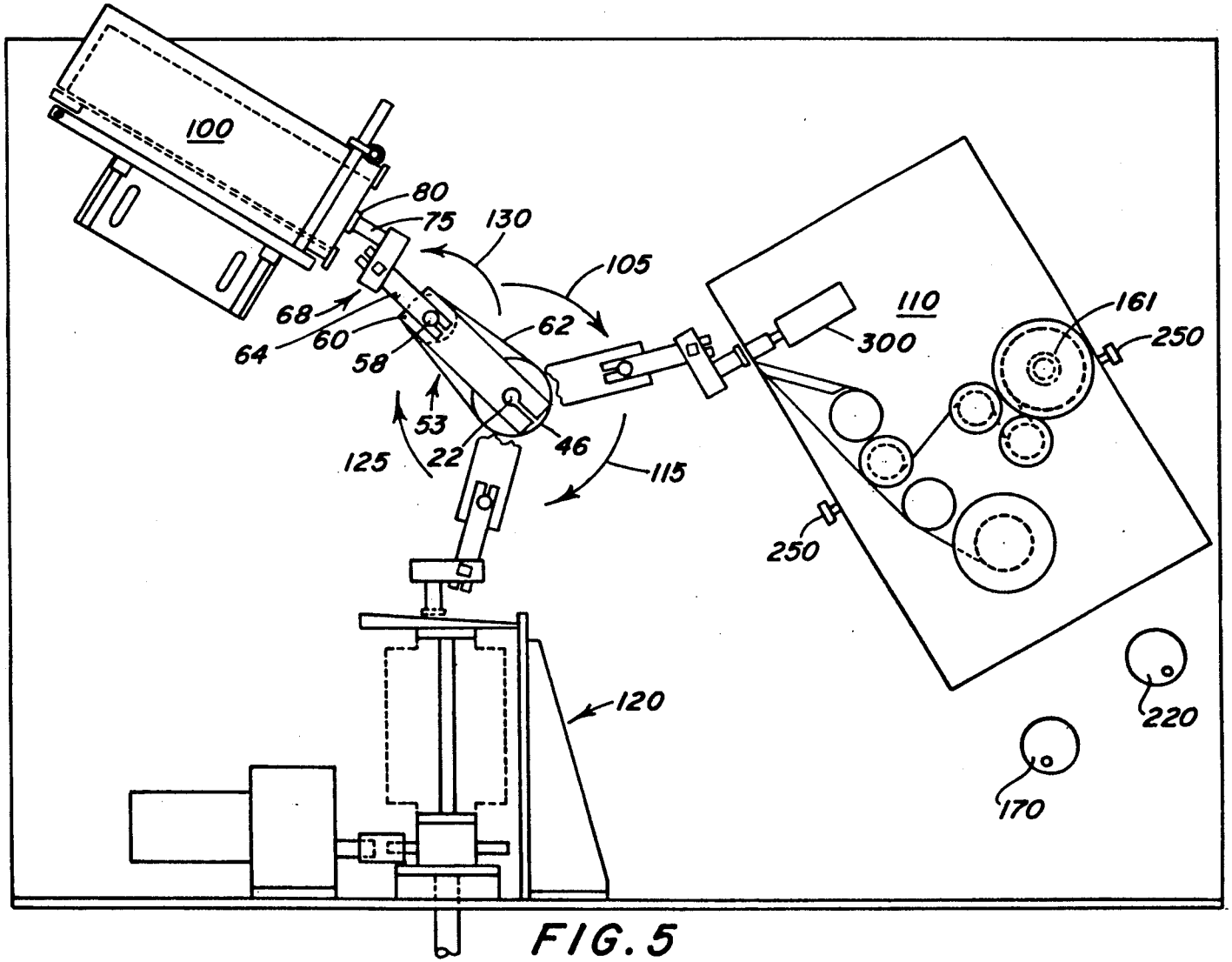
FIG. 5 is a front view of the product label handling machine of the present invention illustrating a three station product label handling arrangement.

Referring now to FIG. 5, there is shown an embodiment of the label handling machine of the present invention involving the use of three different workpiece stations: a magazine station for holding a plurality of sheet-like label workpieces, a treatment station (like that disclosed in my co-pending application Ser. No. 095,687) for applying a sticker or tag to each of the workpieces, and a deposit station for receiving the treated workpieces. It is to be understood that the label handling machine of the present invention is also adaptable to an embodiment involving more than three workpiece stations.

Sheet-like product labels or still further sheet-cut paper type labels have inherent handling problems that may be caused by the paper stock itself before manufacturing of the labels. For example, printing, cutting, stacking, and storage environment (humidity), may cause a wavy or curled paper stock. Different paper stocks cause different problems but usually lighter weight stocks cause more problems than heavier-weight stocks. The wavy or curled sheet cut paper type label does not allow a fixed vacuum cup device a consistent and rapid removal of the sheet type label from the magazine.

As shown in FIG. 5, when the axis of cylinder 75 is presented perpendicular to a presentation surface of a first workpiece pick-up station 100 such as a label magazine, the outer surface of suction cup 80 of suction device 68 is presented parallel to the presentation surface of the first workpiece pickup station 100. At this point, the vacuum source is operated so that the suction device contacts and removes a workpiece from the magazine and the driven shaft and arm means 53 rotate in the direction of arrow 105 to a second workpiece treatment station 110 such as a tag or sticker applicator which then applies, for example, a price sticker to the workpiece. From this point the arm means 53 is then rotated in the direction of arrow 115 to a third workpiece deposit station 120 at which the control means **30*a* operates diverter valve 30 to deactivate vacuum source 30*c*, then activate the pressurized air source 30*b*, to provide a burst of air to release the workpiece from suction cup 80. From this station, the shaft 22 continues to rotate in the direction of arrow 125 to station 100, thus deactivating pressurized air source 30*b* and reactivating vacuum source 30*c*. During rotation between the various stations, the direction of rotation of pulley 60 is as indicated by arrow 130. According to the illustration of FIG. 5, as the arm means 53 is continuously rotated in a clockwise direction, the crank arm 64 is continuously rotated in a counterclockwise direction. The relative motions between arm means 53 and crank arm 64 cause two distinct cycloidal curve paths to be traced by the axis of the support rod 66 and the outer surface of suction cup 80. The axis of the support rod 66 describes a triple loop curve and the surface of suction cup 80 describes a triple cusp curve. The triple loops and triple cusps correspond to, and are in alignment with, the three work stations 100, 110, 120. And, it is further noted that an instantaneous dwell is created as the axis of cylinder 75 becomes perpendicular with the presentation surface of each work station 100, 110, 120, i.e., at the instant when suction cup 80 is presented parallel to the presentation surface of each work station 100, 110, 120. This situation is brought about by the cusp curve described by the surface of suction cup 80**. It is to be further understood that these motions are created between the various elements regardless of the number of stations used in the workpiece handling and transporting apparatus.

It is important to note that the rotation of the driven shaft 22 is continuous. Thus, the operation of the label handling device between the various workpiece stations is continuous. Furthermore, the outer surface of the suction cup 80 of suction device 68, through proper gearing relationship between pulleys 46 and 60, sprockets 46' and 60' or gears 46" and 60", is always presented parallel to the presentation surfaces of each of the workpiece stations 100, 110 and 120 at the instant in time when the suction cup 80 contacts each of the various workpiece station presentation surfaces. Such a situation is effected by the instantaneous dwell of the outer surface of suction cup 80 described above.

As previously noted, it is also possible to employ more than three workpiece stations. If more than three workpiece stations are used, the gearing between pulleys 46 and 60, sprockets 46' and 60' or gears 46" and 60", will be accordingly adjusted such that the outer surface of suction cup 80 of suction device 68 will function just as in the embodiment depicted in FIG. 5. That is, the outer surface of suction cup 80 will be presented parallel to the presentation surfaces of each of the workpiece stations at the instant in time when the suction cup contacts each of the various workpiece station presentation surfaces, regardless of the number of stations.

And, irrespective of the number of workpiece stations employed, the stations will always be equaliangularly spaced o about central driven shaft 22, 22' , 22", etc.

As mentioned previously, FIG. 1 illustrates flange members 32 and 34 which are provided on the outer circumference of shaft 22 intermediate the ends thereof. Flange members 32 and 34 are triggering mechanisms for activating and deactivating the vacuum source 30c and the pressurized air source 30b, and at least one workpiece treatment station, respectively. The workpiece treatment station may comprise a sticker or tag applicator such as that disclosed in my co-pending application Ser. No. 095,687 incorporated herein by reference.

The flange members 32, 34 do not extend completely around the outer circumference of shaft 22 but, instead, are provided with gaps. The particular arc lengths of the flange 32 and its associated gap determine the length of time the vacuum source 30c and pressurized air source 30b will be activated. The flange 34 actuates a workpiece treatment station. For example, when using a tag or sticker applicator, flange 34 acts as a trigger mechanism to feed and apply a new tag or sticker from the treatment station for each revolution of shaft 22.

While the spacing of the gap in flange 32 may be a constant, it is preferably adjustable so as to provide fine pressurized air source 30b are activated. Adjustability of the gap spacing of flange 32 may be realized by forming the flange 32 as the separate flange members 32a, 32b which are adjustable relative to one another. By simply rotating flange members 32a, 32b relative to one another and then clamping them into the desired relative positions about shaft 22 by clamping means 33, the arc lengths of the flange 32 and the gap therein can be accurately adjusted to achieve the desired suction time period and/or pressurized air time period during each revolution of shaft 22.

Flange members 32 and 34 must pass through appropriate switch means in order activate pressurized air source 30b, vacuum source 30c, and the desired workpiece treatment station or stations. Preferably, the switch means for activating and/or deactivating the pressurized air source 30b vacuum source 30c, and the workpiece treatment stations are photocells 36 and 38, respectively. However, any suitable mechanical, electrical, or electro-mechanical limit switches which may be triggered by flanges 32, 34 may be used in place of the photocells 36, 38. The photocells are secured to motor mount 10 by supports 40 and 42, respectively. Photocell 36 is suitably connected to control means 30a which operates diverter valve 30 to appropriately activate and deactivate the pressurized air source 30b and/or the vacuum source 30c during each revolution of shaft 22. Photocell 38 is suitably connected to other control means (not shown) for activating the workpiece treatment station during each revolution of shaft 22.

Figure 8:
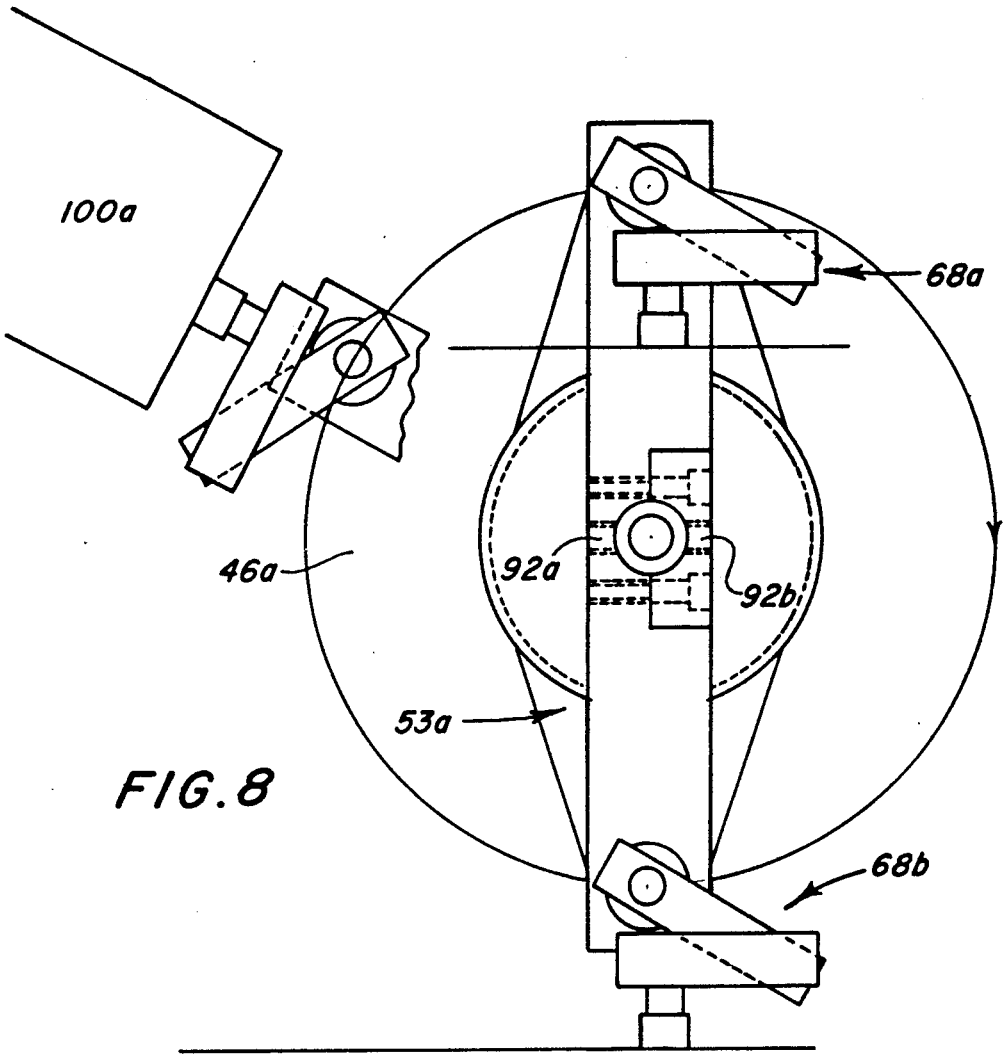
FIG. 8 a front view of the embodiment shown in FIG. 7.

Another embodiment of the invention is illustrated in FIGS. 7 and 8. The embodiment of FIGS. 7 and 8 operates essentially the same as the embodiment illustrated in FIG. 1. Therefore, only the differences between the two embodiments are described hereinbelow. The most important differing feature of the embodiment disclosed in FIGS. 7 and 8 is that the label handling device uses a dual arm means 53a rather then the single arm means 53 shown in FIG. 1. Dual arm means 53a comprises a single member which is fixedly secured at a mid-portion thereof to driven shaft 22a. Opposite ends of arm means 53a rotatably support, through bearings 59a, rotatable shafts 58a, 58b, and thus, suction devices 68a, 68b. Pulleys 60a and 60b are fixedly 15 secured to shafts 58a and 58b, respectively. Pulleys 60a and 60b are linked to a single stationary pulley 46a which is fixedly secured to housing 4a by belts 62a and 62b, respectively. The locations of pulleys 60a and 60b on shafts 58a and 58b, such that the belts 62a and 62b do not interfere with one another during operation of label handling device.

Shaft 22a is rotatably supported and driven substantially the same as shaft 22 of FIG. 1. Shaft 22a has contained therein an inner cylinder 23a of substantially the same length as shaft 22a. The inner diameter of shaft 22a is sufficiently greater than the outer diameter of cylinder 23a such that an annular space 27a is formed between shaft 22a and cylinder 23a. Cylinder 23a has a longitudinal bore 26a extending completely therethrough which substantially corresponds to bore 26 in shaft 22 of FIG. 1.

Bore 26a and annular space 27a communicate with ports 29a and 29b, respectively, of a rotatable pressure coupling 28a which is similar in function to coupling 28 of FIG. 1. Coupling 28a, like coupling 28, communicates with a suitable vacuum source similar to vacuum source 30c and a suitable pressurized air source similar to pressurized air source 30b. The vacuum source used in the embodiment of FIGS. 7 and 8 must be capable of supplying individual suction forces, at different times, to bore 26a and annular space 27a; and the vacuum source must have at least two separate switches and vacuum systems to perform this task. Obviously, the pressurized air source used in the embodiment of FIGS. 7 and 8 must operate similar to, and have virtually the same characteristics as, the vacuum source.

Bore 26a communicates with lateral port 92a in dual arm means 53a. Port 92a communicates via tubing (not shown) with a lateral port 88a in shaft 58b, which, of course, communicates with suction device 68a.

Annular space 27a communicates with lateral port 92b in arm means 53a via tubing (not shown) to a lateral port in shaft 58a, which communicates with suction device 68b.

The annular space 27a and bore 96b are prevented from communicating with one another by conventional O-ring seals 26b.

Mounted to the outer circumference of shaft 22a, is a double-gapped flange 34a having gaps spaced 180 degrees apart. During rotation of shaft 22a, the double-gapped flange 34a passes through a suitable switch (not shown) connected to a treatment station such as a sticker or tag applicator. By virtue of the two gaps in flange 34a, the applicator is capable of feeding and applying two separate stickers for application to two separate labels during 180 degree intervals of a single revolution of shaft 22a.

Also mounted to the circumference of shaft 22a are separate, but appropriately timed, single-gapped flanges 32c and 32d with pass through two other separate switches (not shown). The two separate switches are, in turn, connected to two separate vacuum systems in the vacuum source and two separate pressurized air systems in the pressurized air source. By arranging the gaps of flanges 32c and 32d 180 degrees out of phase with one another, and appropriately phasing these gaps with the gaps of flange 34a, a label handling system having twice the capacity of that presented in the FIG. 1 embodiment is successfully achieved.

Figure 10:
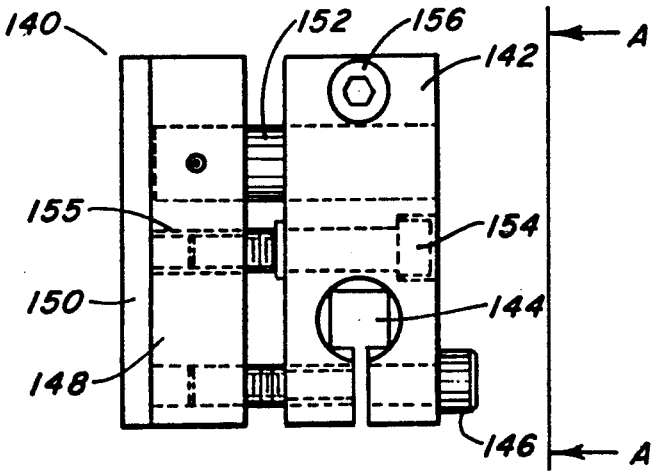
FIG. 10 is an enlarged side view of a stamp pad assembly used in the present invention.
Figure 10A:
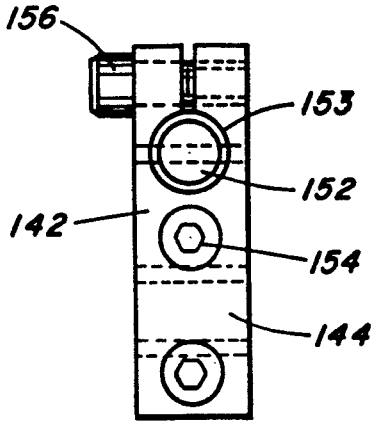
FIG. 10A is a view taken along line A—A of FIG. 10.

Referring now to FIGS. 10 and 10A, there is shown a stamp pad assembly 140 which, like suction device 68, is also carried by support rod 66 during operation of the product label handling machine 2. As most clearly seen in FIG. 10, stamp pad assembly 140 includes a mounting member 142 having an aperture 144 therein which is slightly larger than, but generally corresponding to, the size and cross-sectional shape of support rod 66. Stamp pad assembly 140 is adjustably positionable along the length of support rod 66 by loosening clamping bolt 146, appropriately positioning stamp pad assembly 140, and then tightening the stamp pad assembly to the desired position. One or more stamp pad assemblies may be provided along support rod 66. The purpose of the stamp pad assembly 140 is to provide support for the region of the workpiece or label to which a sticker or tag is applied by the workpiece treatment station 110 such that the label does not become torn or otherwise damaged during the application of the tag or sticker to the label.

Stamp pad assembly 140 further includes a stamp pad support 148 which supports a silicone stamp pad 150. Stamp pad support 148, and thus stamp pad 150, is adjustably positionable relative to mounting member 142. Support 148 is secured to a rod means 152 which passes through an aperture 153 in mounting member 142. An adjustment screw 154 passes through mounting member 142 and is threadably engaged in threaded aperture 155 of stamp pad support 148. By turning adjustment screw 154, the stamp support 148, and thus stamp pad 150, is set to a desired position relative to mounting member 142. In order to lock the position of stamp support 148 and stamp pad 150 relative to mounting member 142, one must simply tighten clamping screw 156 located adjacent, but transverse to, aperture 153 in mounting member 142. Further advantages provided by the adjustable stamp pad assembly 140 are described hereinbelow.

Figure 11:
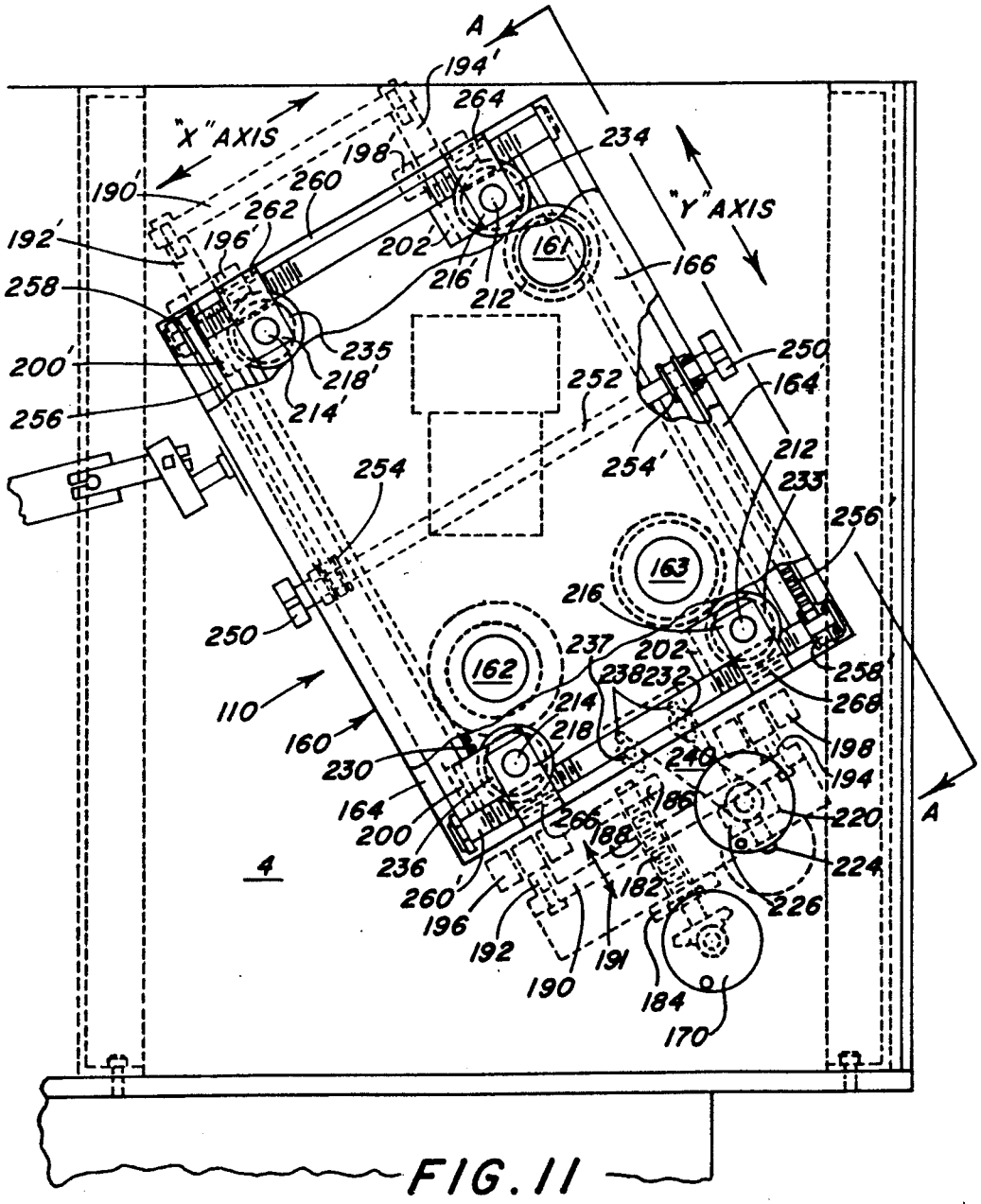
FIG. 11 is an enlarged front view, partially in section, of a workpiece treatment station usable with the present invention and the position adjustment system therefor.
Figure 11A:
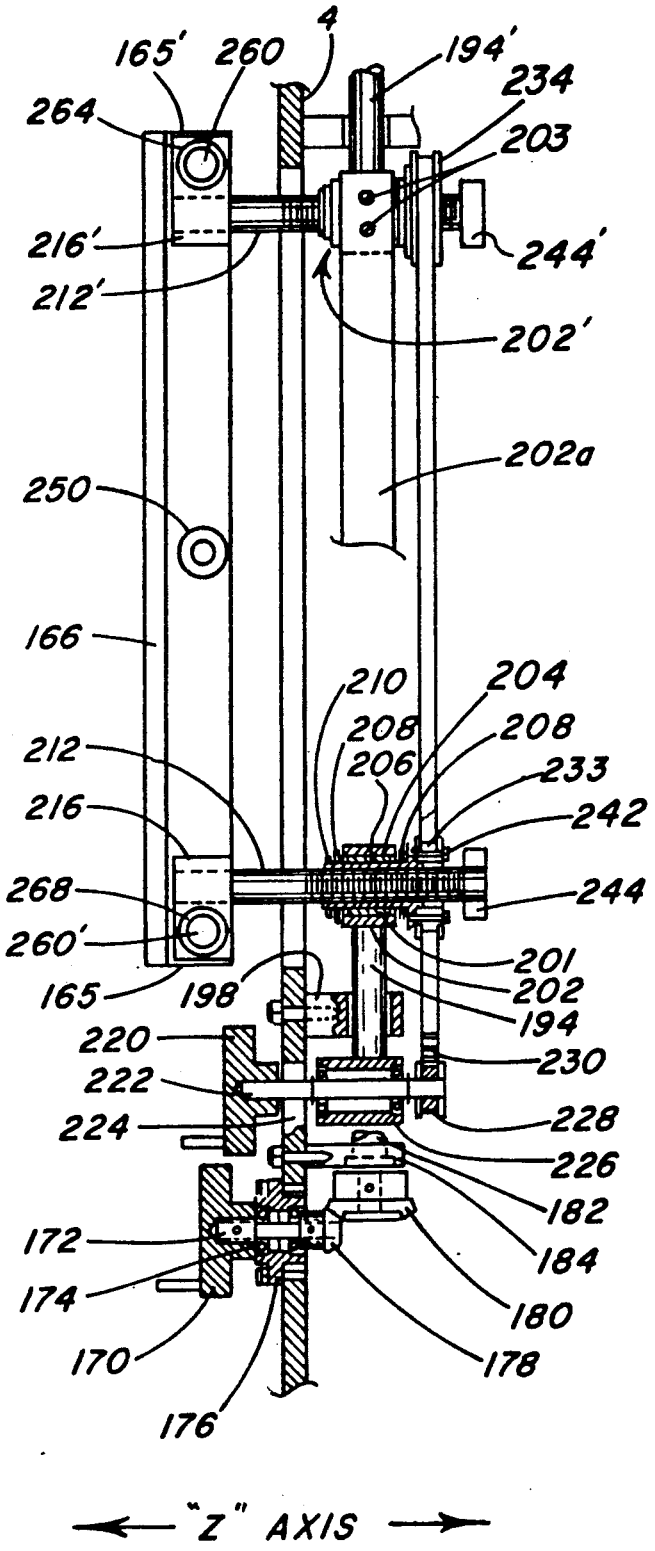
FIG. 11A is a view along line A—A of FIG. 11.

FIGS. 11 and 11A represent in greater detail the workpiece treatment station 110. As noted previously, the workpiece treatment station is similar in structure and function to the apparatus disclosed in my co-pending application Ser. No. 095,687, now U.S. Pat. No. 4,867,833 and is used to feed and apply a tag or sticker to each of the workpieces or labels supplied by the label handling means. Workpiece treatment station 110 includes a frame 160 which houses a tag or sticker storage reel 161, a tag or sticker drive roll 162, and a tag or sticker backing strip take-up reel 163. Similarly, the label dispenser of my prior U.S. Pat. No. 4,867,833 includes a frame or housing similar to frame 160 which supports a label dispensing reel (corresponding to reel 161), a drive roll (corresponding to drive roll 162), and a scrap web or backing strip take-up reel (corresponding to take-up reel 163). Frame 160 is rigidly formed by spaced parallel side members 164 and 164' and spaced parallel end members 165 and 165'. Secured to and covering the frame 160 is a plate 166.

A unique quality of frame 160 is that it is movable along three mutually perpendicular axes, the "x" axis and "y" axis shown in FIG. 11, and the "z" axis shown in FIG. 11A. The novel advantage of providing frame 160 with three degrees of motion is that the workpiece treatment station is universally adjustable so that it can apply a tag or sticker to any region of the surface of the workpiece or label which is presented to the workpiece treatment station.

The motion of frame 160 will first be discussed by reference to the "y" axis, then followed by reference to the "z" axis, and lastly, by reference to the "x" axis.

A first rotatable adjustment knob 170 is used for manual adjustment of the frame 160 along the "y" axis shown in FIG. 11. Knob 170 is secured to a first end of a shaft 172 which, in turn, is rotatably supported by bearings 174. Bearings 174 are housed in bearing housing 176 which is attached to product label handling machine housing 4. Bevel gear 178 is secured to the opposite end of shaft 172 and mates with bevel gear 180.

Bevel gear 180 is secured to a first end of a threaded shaft 182. Shaft 182 passes through, and is rotatably supported in, a first block 184. At its second end, shaft 182 passes through, and is rotatably supported in, a second block 186. Spaced blocks 184 and 186 are each secured to a rear wall surface of housing 4; and threaded shaft 182 is held axially stationary in spaced support blocks 184 and 186. Intermediate blocks 184 and 186, threaded shaft 182 threadably engages with a threaded aperture 188 in a drive bar 190. At this point one can see that rotation of knob 170 turns bevel gear 178, which turns bevel gear 180. Bevel gear 180 rotates shaft 182 and the threads of rotating shaft 182 engage with the threads of aperture 188 in drive bar 190 to translate bar 190 in the direction shown by arrow 191 (or along the "y" axis).

Opposite ends of drive bar 190 are fixedly secured to first ends of shafts 192 and 194, respectively. Shafts 192 and 194 pass through and are slidably received in blocks 196 and 198, respectively. Blocks 196 and 198, like blocks 184 and 186, are each secured to a rear wall surface of housing 4. Second ends of shafts 192 and 194 are respectively secured to bearing support blocks 200 and 202. The structure of bearing support block 202 is illustrated in FIG. 11A, and that structure is the same for bearing support block 200 as well as their "mirror images" 200' block 202 is rigidly connected to bearing support block 202' by an elongated rigid connecting member 202a extending therebetween. Member 202a is fastened to bearing support blocks 202 and 202' by suitable fasteners 203. Elongated rigid connecting member 202a is partially shown in FIG. 11A; and a similar connecting member (not shown) connects bearing support blocks 200 and 200'. It can now be seen that bearing blocks 200, 202, 200' and 202' are translated together as a frame-like unit along the "y" axis by bar 190 and shafts 192 and 194. Fixedly secured to bearing blocks 200' and 202' are shafts 192' and 194' respectively. Opposite ends of the shafts 192' and 194' are connected to a bar 190'. Shafts 192' and 194' pass through and are slidably supported in blocks 196' and 198' which are secured, like blocks 196 and 198, to a rear wall surface of housing 4. Bar 190', unlike bar 190, has no threaded aperture and is not translated by a threaded shaft. Bar 190', shafts 192' and 194', and blocks 196' and 198', perform the function of maintaining the bearing support blocks, and as will be seen, frame 160 in proper alignment with the "y" axis during translation therealong.

As shown in FIG. 11A, rotatably supported by bearing 204 in bearing support block 202 is internally threaded sleeve 206. Threaded sleeve 206 is essential for the "z" axis adjustment of frame 160 as will be described in detail hereinbelow. Threaded sleeve 206 and bearing 204 are retained in position relative to bearing support block 202 by spaced thrust bearings 208 and snap ring 210. Threadably received in threaded sleeve 206 is threaded rod 212. Threaded rod 212, as will be described later, cooperates with threaded sleeve 206 in the adjustment of the frame 160 along the "z" axis. A first end of threaded rod 212 is fixedly secured to a support block 216 which threadably receives therein a threaded shaft 260' which is rotatably received in and connected to side members 164 and 164' of frame 160. As will be described in greater detail hereinbelow, threaded rod 260' and an identical threaded rod 260, which is parallel to but spaced from threaded rod 260', cooperate to translate frame 160 along the "x" axis.

Bearing support block 200 is similarly connected to frame 160 through threaded shaft 214, support block 218 and threaded rod 260'. The connection of "mirror image" bearing support blocks 200' and 202' to frame 160 is identical in all respects to that described with regard to bearing support blocks o 200 and 202 except that bearing blocks 200' and 202' are connected to frame 160 through their cooperation with threaded rod 260. As can now be readily seen, the frame 160 is translatable along the "y" axis by turning knob 170 which is connected through gearing 178, 180 to threaded rod 188 which threadably engages and drives a translatable drive bar 190. Drive bar 190 is secured to and translates shafts 192 and 194 along "y" axis. Shafts 192 and 194, through connected bearing support block pairs 200, 200' and 202, 202', threaded shafts 212, 214, 212' and 214', and support blocks 216, 218, 216' and 218', are secured to and translate frame 160 along the "y" axis. "Mirror image" shafts 192' and 194' are similarly connected to frame 160 and, as noted previously, in cooperation with blocks 196' and 198', and bar 190', they maintain alignment of the frame 160 as it is translated along the "y" axis.

Translation of the frame 160 along the "z" axis as shown in FIG. 11A is described hereinbelow.

A second rotatable adjustment knob 220 is used for manual adjustment of the frame 160 along the "z" axis shown in FIG. 11A. Knob 220 is secured to a first end of a shaft 222 which passes through an elongated slot 224 in housing 4 which extends in the direction of the "y" axis. Shaft 222 is rotatably supported by suitable bearings in a bearing housing 226. Bearing housing 226 is fastened to, and is translatable with, drive bar 190. The connection of bearing housing 226 with drive bar 190 can be seen in FIG. 11. At a second end of shaft 222 there is secured a drive pulley 228. An endless belt 230 is driven by drive pulley 228 in order to translate the frame 160 along the "z" axis as will be described hereinbelow.

Belt 230 passes from drive pulley 228 to idler pulley 232 then to pulleys 233, 234, 235 and 236 to a second idler pulley 237 and then back to drive pulley 228. The tension in belt 230 is adjusted by selectively positioning idler pulleys 232 and 237 along slots 238 provided in bracket 240. Bracket 240 is fastened to, and is translatable with, drive bar 190. The simultaneous rotation of pulleys 233, 234, 235 and 236 by belt 230 operates to translate the frame 160 along the "z" axis shown in FIG. 11A.

As noted previously, the threaded rods 212, 212', 214 and 214' are essential in effecting translation of the frame 160 along the "z axis". Since the construction and interaction of the threaded rods with their associated bearing support blocks are identical, only the description of threaded rod 212 and its interaction with its support block 202 will be described in detail. As can be seen from FIG. 11A, threaded rod 212 is threadably received in threaded sleeve 206, with sleeve 206 being rotatably supported in bearing support block 202 by bearing 204. Secured by fasteners 242 to a circumferential flange of threaded sleeve 206 is pulley 233. As is apparent, rotation of pulley 233 causes corresponding rotation in threaded sleeve 206 which, in turn, translates threaded rod 212 along the "z" axis. The forward translation (i.e., outward from the plane of FIG. 11) of threaded rod 212 is limited by a stop member 244 secured to a rear portion thereof. This structural arrangement is identical with respect to the structure and operation of threaded rods 212', 214 and 214'. Thus, by turning knob 220, one can, through the connection of belt 230 with pulleys 233, 234, 235 and 236, simultaneously drive these pulleys to translate frame 160 along the "z" axis. Preferably, pulleys 228 and 233-236 are toothed pulleys and belt 230 is a toothed belt so that positive, nonslipping interaction is at all times maintained between the belt and pulleys.

Translation of the frame 160 along the "x" axis as shown in FIG. 11 is described herebelow. A pair of knobs 250 are fixedly secured to opposite ends of a shaft 252 which extends between and is rotatably supported in side members 164, 164' of frame 160. Fixedly secured to shaft 252 immediately adjacent and inwardly of side member 164 is a pulley 254. A similar pulley 254' is fixed to shaft 252 immediately adjacent and inwardly of side member 164'. Rotation of shaft 252 simultaneously turns o pulleys 254 and 254'A belt 256 cooperates with pulley 254 and extends in the direction of frame end member 165' where it then cooperates with a pulley 258. Pulley 258 is fixedly secured to previously recited threaded shaft 260. Threaded shaft 260 is rotatably supported at opposite ends thereof in suitable bearings provided in side members 164 and 164' of frame 160. Threaded shaft 260 also passes through threaded bushings 262 and 264 fixedly received in previously-recited support blocks 218' and 216', respectively. This construction is essentially repeated but inverted with regard to belt 256', pulley 258', threaded shaft 260', and threaded bushings 266 and 268. As is apparent, rotation of knobs 250 causes simultaneous rotation in belts 256 and 256' to simultaneously rotate threaded shafts 260 and 260' within threaded bushings 262, 264 and 266, 268, respectively, in order to translate frame 160 along the "x" axis. Once again, it is preferred that the pulleys and belts be toothed for the reasons mentioned above.

The virtual universal adjustability of frame 160 along the three mutually perpendicular "x", "y" and "z" axes permits a sticker or tag application cylinder 300 (FIG. 5) to apply a sticker to virtually any desired region of a label which is presented by the label handling machine to the workpiece treatment station or sticker applicator 110. Tag application cylinder 300 corresponds substantially to a similarly arranged piston and cylinder assembly described in U.S. Pat. No. 4,867,833.

And, the adjustability of stamp pad assembly 140 along support rod 66 permits stamp pad 150 to be placed in alignment with cylinder 300 so that stamp pad 150 will provide support for the region of the workpiece or label which is impacted by the cylinder 300 in order to prevent tearing or other damage to the label which may be caused by impact from cylinder 300.

It is further contemplated that manual knobs 250, 170 and 220 for adjusting frame 160 along the "x", "y" and "z" axes, respectively, may be suitably replaced by low-power hydraulic, pneumatic or electrical motors, and the like, and suitable controls therefor.

While the present invention has been described in connection with the preferred embodiment of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

I claim:

1. An apparatus for transporting a workpiece between a plurality of stations including at least one workpiece pick-up station, at least one workpiece treatment station and at least one workpiece deposit station, said apparatus comprising:

a housing, a motor, and a first shaft rotatably driven by the motor;

means for handling said workpiece; and means for connecting said first shaft to said handling means for transporting the handling means between said plurality of stations, said means for connecting including:

first pulley means fastened to said housing;

arm means fixedly secured at a mid-portion thereof to said first shaft, said arm means rotatably supporting, at opposite ends thereof, second and third shafts substantially parallel to said first shaft;

second pulley means fixedly secured to a first end of said second shaft;

third pulley means fixedly secured to a first end of said third shaft; and belt means for linking said first pulley means to said second pulley means and for linking said first pulley means to said third pulley means, whereby the arrangement of the connecting means is such that rotation of said first shaft in a first direction causes a corresponding rotational translation of said arm means in said first direction, and, through cooperation of said first pulley means, said second pulley means, said third pulley means, and said belt means, an opposite rotation is obtained in said second shaft and said third shaft.

2. The apparatus of claim 1, wherein said first, second and third pulley means are toothed pulleys and said belt means comprise first and second toothed belts, whereby the teeth of the first belt positively engage the teeth of the first and second pulleys to prevent slippage of the first belt about the first and second pulleys and the teeth of the second belt positively engage the teeth of the first and third pulleys to prevent slippage of the second belt about the first and third pulleys.

3. The apparatus of claim 1, wherein the connecting means further comprise first crank means rigidly secured, at a firs end thereof, to a second end of said second shaft and second crank means rigidly secured, at a first end thereof, to a second end of said third shaft.

4. The apparatus of claim 3, wherein the connecting means further comprise first and second rod means for supporting said handling means, said first rod means being rigidly secured to and extending outwardly from a second end of said first crank means, said second rod means being rigidly secured to and extending outwardly from a second end of said second crank means, said first and second rod means extending substantially parallel to said first, second and third shafts.

5. The apparatus of claim 4, wherein said handling means include at least one suction means.

6. The apparatus as in claim 5 further comprising means associated with said first shaft for causing said suction means to engage and hold a workpiece as said workpiece is first picked up at said at least one workpiece pick-up station and then transported to said at least one workpiece treatment station; said means associated with said first shaft further causing said suction means to release said workpiece as said workpiece is transported to said at least one workpiece deposit station.

7. The apparatus of claim 5, further comprising means for adjustably positioning said at least one suction means along the lengths of said first and second rod means.

8. The apparatus of claim 7 wherein the suction means are connected to tubing means; the tubing means being connected to port means in said second and third shafts; the port means in said second and third shafts being connected to port means in said first shaft; the port means in said first shaft being connected to a source of suction.

9. An apparatus for transporting a workpiece between a plurality of stations including magazine means, tag applicator means and at least one workpiece deposit station, said apparatus comprising:

a housing, a motor, and a first shaft rotatably driven by the motor;

means for handling said workpiece, said means for handling including at least one suction means;

means for connecting said first shaft to said handling means for transporting the handling means between said plurality of stations;

first means associated with said first shaft for causing said tag applicator means to present a new tag for application to said workpiece each time a new workpiece is transported from said magazine means to said tag applicator means; and means carried by said housing for translating said tag applicator means relative to said housing along at least one axis for adjusting the position of said tag applicator means in order to control the location upon said workpiece at which said tag applicator means applies a tag to said workpiece.

10. The apparatus of claim 9, further comprising second means associated with said first shaft for causing said suction means to engage and hold a workpiece as said workpiece is first picked up at said magazine means and then transported to said tag applicator means; and second means associated with said first shaft further causing said suction means to release said workpiece after said workpiece is transported to said at least one workpiece deposit station.

11. The apparatus of claim 10 wherein said second means includes means for generating an air blast to separate said workpiece from said suction means.

12. The apparatus of claim 9 wherein said translating means further comprise means for permitting translation of said at least one workpiece treatment station along two perpendicular axes.

13. The apparatus of claim 9 wherein said translating means comprise means for permitting translation of said at least one workpiece treatment station along three mutually perpendicular axes.

14. An apparatus for transporting a workpiece between a plurality of stations including magazine means, tag applicator mean and at least one workpiece deposit station, said apparatus comprising:

a housing, a motor, and a first shaft rotatably driven in a first direction by the motor;

means for handling said workpiece;

means for connecting said first shaft to said handling means for transporting the handling means between said plurality of stations;

first means associated with said first shaft for causing said tag applicator means to present a new tag for application to said workpiece each time a new workpiece is transported from said magazine means to said tag applicator means; and means carried by said housing for translating said tag applicator means relative to said housing along two perpendicular axes for adjusting the position of said tag applicator means in order to control the location upon said workpiece at which said tag applicator means applies a tag to said workpiece.

15. The apparatus of claim 14, wherein the handling means has a surface which is presented substantially parallel to a respective presentation surface of each of the plurality of stations when said handling means arrives at each of said plurality of stations.

16. The apparatus of claim 15, wherein said first shaft, through said connecting means, transports said handling means from said magazine means to said tag applicator means and then to said at least one workpiece deposit station.

17. The apparatus of claim 16, wherein said plurality of stations are equaliangularly spaced about said first shaft.

18. The apparatus of claim 14 wherein said translating means comprise means permitting translation of said tag applicator means along three mutually perpendicular axes.

19. The apparatus of claim 14, wherein the connecting mean comprise stationary means fastened to said housing and movable means for transporting said handling means between said plurality of stations.

20. The apparatus of claim 19, wherein said stationary means comprise first pulley means.

21. The apparatus of claim 20, wherein said movable means comprise:

arm means fixedly secured at a first end thereof to said first shaft;

said arm means rotatably supporting, at a second end thereof, a second shaft substantially parallel to said first shaft;

second pulley means fixedly secured to a first end of said second shaft; and belt means for linking said first pulley means to said second pulley means, whereby the arrangement of the connecting means is such that rotation of said first shaft in said first direction causes a corresponding rotational translation of said arm means in said first direction, and, through cooperation of said first pulley means, said second pulley means, and said belt means, an opposite rotation is obtained in said second shaft.

22. The apparatus of claim 21, wherein said first and second pulley means are toothed pulleys and said belt means is a toothed belt, whereby the teeth of the belt positively engage the teeth of the pulleys to prevent slippage of the belt about the pulleys.

23. The apparatus of claim 19, wherein said stationary means comprise firs sprocket means.

24. The apparatus of claim 23, wherein said movable means comprise:

arm means fixedly secured at a first end thereof to said first shaft;

said arm means rotatably supporting, at a second end thereof, a second shaft substantially parallel to said first shaft;

second sprocket means fixedly secured to a first end of said second shaft; and chain means for linking said first sprocket means to said second sprocket means, whereby the arrangement of the connecting mean is such that rotation of said first shaft in said first direction causes a corresponding rotational translation of said arm means in said first direction, and, through cooperation of said first sprocket means, said second sprocket means, and said chain means, an opposite rotation is obtained in said second shaft.

25. The apparatus of claim 19, wherein said stationary means comprise first gear means.

26. The apparatus of claim 25, wherein said movable means comprise:

arm means fixedly secured at a first end thereof to said first shaft;

said arm means rotatably supporting, at a second end thereof, a second shaft substantially parallel to said first shaft;

second gear means fixedly secured to a first end of said second shaft; and idler gear means for linking said first gear means to said second gear means, whereby the arrangement of the connecting mean is such that rotation of said first shaft in said first direction causes a corresponding rotational translation of said arm mean in said firs direction, and, through cooperation of said first gear means, said second gear means, and said idler gear means, an opposite rotation is obtained in said second shaft.

27. The apparatus of claim 21, wherein the connecting means further comprise crank means rigidly secured, at a first end thereof to a second end of said second shaft.

28. The apparatus of claim 27, wherein the connecting means further comprise rod means for supporting said handling means, said rod means being rigidly secured to and extending outwardly from a second end of said crank means substantially parallel to said first and second shafts.

29. The apparatus of claim 24, wherein the connecting means further comprise crank means rigidly secured, at a first end thereof, to a second end of said second shaft.

30. The apparatus of claim 29, wherein the connecting means further comprise rod means for supporting said handling means, said rod means being rigidly secured to and extending outwardly from a second end of said crank means substantially parallel to said first and second shafts.

31. The apparatus of claim 26, wherein the connecting means further comprise crank means rigidly secured, at a first end thereof, to a second end of said second shaft.

32. The apparatus of claim 31, wherein the connecting means further comprise rod means for supporting said handling means, said rod means being rigidly secured to and extending outwardly from a second end of said crank means substantially parallel to said first and second shafts.

33. The apparatus of claim 28, wherein said handling means comprise at least one suction means adjustably positionable along the length of said rod means.

34. The apparatus of claim 30, wherein said handling means comprise at least one suction means adjustably positionable along the length of said rod means.

35. The apparatus of claim 32, wherein said handling means comprise at least one suction means adjustably positionable along the length of said rod means.

36. The apparatus of claim 33, wherein the suction means are connected to tubing means; the tubing means being connected to port means in said second shaft; the port means in said second shaft being connected to port means in said first shaft; the port means in said first shaft being connected to a source of suction.

37. The apparatus of claim 36 further comprising means for generating an air blast to separate said workpiece from said suction means.

* * * * *